US007824236B2

(12) United States Patent
Sawada et al.

(10) Patent No.: US 7,824,236 B2
(45) Date of Patent: Nov. 2, 2010

(54) CONNECTING TERMINAL

(75) Inventors: Shigeru Sawada, Yokkaichi (JP); Hideo Hoshi, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 97 days.

(21) Appl. No.: 12/311,179

(22) PCT Filed: Oct. 3, 2007

(86) PCT No.: PCT/JP2007/069356

§ 371 (c)(1),
(2), (4) Date: Mar. 27, 2009

(87) PCT Pub. No.: WO2008/041721

PCT Pub. Date: Apr. 10, 2008

(65) Prior Publication Data

US 2009/0239425 A1 Sep. 24, 2009

(30) Foreign Application Priority Data

Oct. 3, 2006 (JP) ..... 2006-271467

(51) Int. Cl.
*H01R 11/01* (2006.01)

(52) U.S. Cl. ..... 439/877

(58) Field of Classification Search ..... 439/877–878, 439/884–885

See application file for complete search history.

(56) References Cited

U.S. PATENT DOCUMENTS

| | | | | |
|---|---|---|---|---|
| 3,550,067 | A * | 12/1970 | Hansen | 439/748 |
| 4,655,518 | A * | 4/1987 | Johnson et al. | 439/62 |
| 5,746,608 | A * | 5/1998 | Taylor | 439/70 |
| 6,210,239 | B1 * | 4/2001 | Harting et al. | 439/814 |
| 2008/0207009 | A1 * | 8/2008 | Osada | 439/34 |

FOREIGN PATENT DOCUMENTS

JP A-11-67311 3/1999

* cited by examiner

*Primary Examiner*—T C Patel
*Assistant Examiner*—Phuong Nguyen
(74) *Attorney, Agent, or Firm*—Oliff & Berridge, PLC

(57) ABSTRACT

A connecting terminal developed speedily while limiting a temperature rise when a current flows, comprising male and female terminals each having a wire crimp portion to which a wire is crimped, and a joint portion where the male and female terminals are joined to each other, wherein a contact resistance value of the whole connecting terminal is a sum of contact resistance values in the wire crimp portions and the joint portion, and a length of a contact portion is a sum of lengths of the wire crimp portions and the joint portion, wherein a normalized contact resistance value $R_{ter}$ is derived by dividing the contact resistance value by the length, and a relationship of a wire resistance value $R_{wire}$ of the wire, a current value I and a permissive increase in temperature $\Delta T$ to the normalized contact resistance value $R_{ter}$ is expressed by $R_{ter}<\Delta T/(752\times I^2)-3.7\times R_{wire}$.

1 Claim, 9 Drawing Sheets

CONNECTING TERMINAL

TECHNICAL FIELD

The present invention relates to a connecting terminal, and more specifically relates to a connecting terminal preferably used for an electrical wiring through which a large amount of current flows of an automobile, an industrial equipment or other equipment.

BACKGROUND ART

Conventionally, a connecting terminal is used in an electrical wiring of an automobile, industrial equipment or other equipment. When the connecting terminal is used in a circuit through which a large amount of current flows of a charging equipment of an electric car or other equipment for example, extremely large heat is generated at a contact point of the connecting terminal, and therefore various countermeasures such as upsizing the connecting terminal, attaching a cooling fin, or improving a shape of the connecting terminal are taken for limiting a temperature rise in the connecting terminal.

Japanese Patent Application Unexamined Publication No. H11-67311, for example, discloses an experimental study for improving a shape of a female terminal fitting of a joint type. The publication discloses the female terminal fitting which has a terminal body, on which a contact portion with a tab of a counterpart male terminal fitting is formed to constitute a conductive passage, and a spring piece separated from the terminal body and pressing the tab against the contact portion, in which the terminal body acting as the conductive passage is made thick, while the spring piece not acting as the conductive passage is made thin.

The terminal body acting as the conductive passage is made thick, thereby reducing heat generation at the contact point caused when a large amount of current flows through the female terminal fitting, while the spring piece not acting as the conductive passage is made thin, thereby minimizing the size of the whole female terminal fitting.

DISCLOSURE OF THE INVENTION

Problems to be Solved by the Invention

However, no technique has been present for predicting a heat generation amount and a temperature increase of a prototype connecting terminal when a current flows, and therefore each time a connecting terminal is newly designed and preproduced, it is required to conduct a temperature rise test for measuring the temperature increase of the connecting terminal in order to verify whether or not the temperature increase conforms to a temperature standard of the connecting terminal. For this reason, there is a problem that the connecting terminal is prevented from being designed and developed in a speedy manner.

An object of the present invention is to provide a connecting terminal which can be designed and developed in a speedy manner with the temperature rise being limited when a current flows.

Means to Solve the Problem

As a result of an earnest study, the present inventors obtained such findings that a certain equation allows predicting, in a design phase, a temperature increase of a connecting terminal when a current flows, without conducting an actual measurement of the temperature increase of the connecting terminal when a current flows. The present inventor has completed the present invention based on such findings.

The connecting terminal according to a preferred embodiment of the present invention includes a male terminal having a wire crimp portion to which an end of a wire is crimped, a female terminal having a wire crimp portion to which an end of a wire is crimped; and a joint portion where the male and female terminals are joined to each other, wherein a contact resistance value of the whole connecting terminal is a sum of a contact resistance value in the wire crimp portion of the male terminal, a contact resistance value in the wire crimp portion of the female terminal and a contact resistance value in the joint portion, and a length of a contact portion is a sum of a length of the wire crimp portion of the male terminal, a length of the wire crimp portion of the female terminal and a length of the joint portion, wherein a normalized contact resistance value $R_{ter}$ is derived by dividing the contact resistance value of the whole connecting terminal by the length of the contact portion, and wherein a relationship of a wire resistance value $R_{wire}$ of the wire, a current value I and a permissive increase in temperature $\Delta T$ to the normalized contact resistance value $R_{ter}$ of the connecting terminal is expressed by $R_{ter}<\Delta T/(752\times I^2)-3.7\times R_{wire}$, the permissive increase in temperature $\Delta T$ representing a temperature increase up to a temperature standard of the connecting terminal.

Effects of the Invention

A connecting terminal according to a preferred embodiment of the present invention allows predicting, in a design phase, a temperature increase of a connecting terminal when a current flows. Accordingly, it is not necessary to conduct a temperature rise test for measuring a temperature increase of the connecting terminal to verify whether or not the temperature increase conforms to a temperature standard of the connecting terminal each time a connecting terminal is newly designed and preproduced. This allows the connecting terminal to be designed and developed in a speedy manner. In addition, based on the findings, a contact resistance value $R_{ter}$ is determined such that the temperature increase is smaller than a permissive increase in temperature $\Delta T$ representing the temperature increase of the connecting terminal up to the temperature standard, thereby limiting the temperature rise of the connecting terminal when a current flows.

BEST MODE FOR CARRYING OUT THE INVENTION

Figure 1:
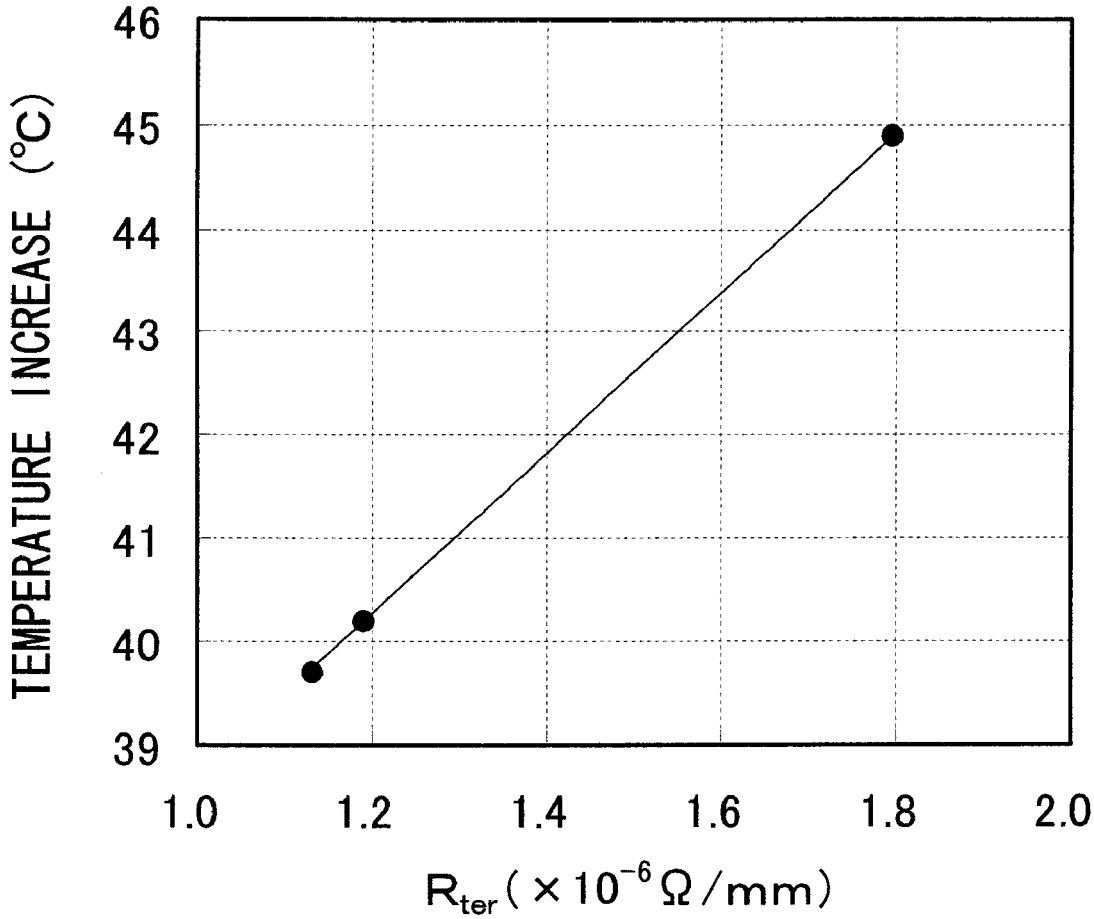
FIG. 1 is a graph showing a relationship between a temperature increase (° C.) and a normalized contact resistance value $R_{ter}$ (Ω/mm) of a connecting terminal at a current value of 100 A, where a wire size is 15 $mm^2$.

A detailed description of a preferred embodiment of the present invention will now be provided with reference to the accompanying drawings.

The connecting terminal according to a preferred embodiment of the present invention is characterized in that a relationship of a wire resistance value $R_{wire}$ (Ω/mm) of a wire, a current value I(A) and a permissive increase in temperature ΔT (° C.) to a normalized contact resistance value $R_{ter}$ (Ω/mm) of the connecting terminal is expressed by $R_{ter} < \Delta T/(752 \times I^2) - 3.7 \times R_{wire}$, the permissive increase in temperature ΔT (° C.) representing a temperature increase up to a temperature standard of the connecting terminal.

The normalized contact resistance value $R_{ter}$ (Ω/mm) of the connecting terminal represents a contact resistance value per unit length of the whole connecting terminal, and the length thereof refers to a length of a contact portion. The normalized contact resistance value $R_{ter}$ (Ω/mm) of the connecting terminal is derived by dividing the contact resistance value (Ω) of the whole connecting terminal by the length (mm) of the contact portion, where the contact resistance value of the whole connecting terminal is a sum of a contact resistance value (Ω) in a wire crimp portion of a male terminal to which an end of a wire is crimped, a contact resistance value (Ω) in a wire crimp portion of a female terminal to which an end of a wire is crimped and a contact resistance value in a joint portion where the male terminal and the female terminal are joined to each other, and the length of the contact portion is a sum of a length of the wire crimp portion of the male terminal, a length of the wire crimp portion of the female terminal and a length of the joint portion.

In the present embodiment, the contact resistance value and the length are expressed by Ω and mm respectively; however, the present invention is not limited hereto, and the contact resistance value and the length may be expressed by μΩ and m respectively.

The reason why the contact resistance value (Ω) of the whole connecting terminal is composed of not only the contact resistance value (Ω) of the joint portion but also those of the wire crimp portions of the male and female terminals is because Jule heat is generated also by the contact resistance in the wire crimp portions when a current flows and contributes the temperature rise of the connecting terminal.

Further, the reason why the contact resistance value is normalized instead of simply applying the contact resistance value (Ω) of the whole connecting terminal without dividing it by the length (mm) of the contact portion is because there are various kinds of connecting terminals having different shapes and sizes. For this reason, when evaluating the temperature rise of the connecting terminals having different shapes and sizes, no correlation is found between the contact resistance and the temperature rise when simply applying the contact resistant value (Ω) of the whole connecting terminal.

The permissive increase in temperature ΔT (° C.) of the connecting terminal represents the temperature increase up to the temperature standard of the connecting terminal. The permissive increase in temperature ΔT (° C.) represents an allowable range of the temperature rise of the connecting terminal, and a temperature rise within this range does not cause any problems. The temperature standard is set for example to 60° C. or less at a current of 100 A. However, the temperature standard varies depending on an environment in which the connecting terminal is used.

Now, a process of deriving the above-mentioned equation will be described below.

In the connecting terminal, correlation is found between the normalized contact resistance value $R_{ter}$ (Ω/mm) and the temperature rise. The temperature rise of the connecting terminal when a current flows through the connecting terminal is determined by a heat storage amount (i.e., a difference between a heat generation amount and a heat dissipation amount). Then, if defining dT as the temperature increase within dt hour, Equation (1) is established.

$$I^2 \times R_{ter} - W = Cp \times dT/dt, \quad \text{Equation (1)}$$

where

I: current value (A)

$R_{ter}$: normalized contact resistance value (Ω/mm) of the connecting terminal W: heat dissipation amount (W/mm) of the connecting terminal Cp: heat capacity (J/K) of the connecting terminal Here, because dT is equal to 0 in a steady state, Equation (1) becomes $I^2 \times R_{ter} - W = 0$. Further, the heat dissipation amount W (W/mm) in the connecting terminal is considered to include heat dissipation into the atmosphere and heat dissipation in the wire, and therefore Equation (2) is established.

$$W = Ka \times \Delta T1 + Kw \times \Delta T2, \quad \text{Equation (2)}$$

where

Ka: heat resistance (W/mm·K) between the connecting terminal and the atmosphere

Kw: heat resistance (W/mm·K) between the connecting terminal and the wire

ΔT1: temperature increase (K) of the connecting terminal

ΔT2: temperature difference (K) between the connecting terminal and the wire Here, in view of a relationship between ΔT1 and ΔT2, Equation (3) is established.

$$\Delta T2 = \Delta T1 + T_{air} - T_{wire}, \quad \text{Equation (3)}$$

where $T_{air}$: atmospheric temperature (K)

$T_{wire}$: wire temperature (K)

To summarize Equations (1) to (3) described above, Equation (4) is established which represents the temperature increase ΔT1 (K) of the connecting terminal.

$$\Delta T1 = \{1/(Ka+Kw)\} \times I^2 \times R_{ter} + \{Kw/(Ka+Kw)\}) \times (T_{wire} - T_{air}) \quad \text{Equation (4)}$$

According to Equation (4), the temperature increase ΔT1 (K) of the connecting terminal is expressed using the normalized contact resistance value (Ω/mm) of the connecting terminal of first order. Here, because $T_{wire}$ varies depending on the current value (A), the heat generation amount (W/mm) of the wire is required to be considered. As a relationship equation representing the heat generation amount (W/mm) of the wire, Equation (5) is established.

$$I^2 \times R_{wire} = K_{wa} \times (T_{wire} - T_{air}), \quad \text{Equation (5)}$$

where $R_{wire}$: wire resistance value (Ω/mm)

Kwa: heat resistance (W/mm·K) between the wire and the atmosphere

According to Equations (4) and (5), the temperature increase ΔT1 (K) of the connecting terminal is expressed by Equation (6).

$$\Delta T1 = \{1/(Ka+Kw)\} \times I^2 \times R_{ter} + \{Kw/Kwa)/(Ka/Kw)\} \times I^2 \times R_{wire} \quad \text{Equation (6)}$$

Here, because each of Ka, Kw and Kwa is a constant, the temperature increase ΔT1 (K) of the connecting terminal is expressed by the normalized contact resistance value $R_{ter}$ (Ω/mm) of the connecting terminal, the wire resistance value $R_{wire}$ (Ω/mm) and the current value I (A) as indicated in Equation (6), and the temperature increase ΔT1(K) of the connecting terminal is calculated by obtaining these values. Equation (6) is expressed as below when simplified.

$$\Delta T1 = \alpha \times I^2 \times R_{ter} + \beta \times I^2 \times R_{wire}, \quad \text{Equation (7)}$$

where

α=1/(Ka+Kw)

β=(Kw/Kwa)/(Ka+Kw)

According to Equation (7), assuming that the same wire and the same current are used, it is found that the temperature increase ΔT1(K) of the connecting terminal is dependent on the normalized contact resistance value $R_{ter}$ (Ω/mm) of the connecting terminal. That is to say, in this case, if the normalized contact resistance value $R_{ter}$ (Ω/mm) is determined, the temperature increase of the connecting terminal is to be determined. Meanwhile, assuming that a wire to be used is changed, the larger the diameter of the wire to be used, the smaller the value of $R_{wire}$, and the smaller the temperature rise. This corresponds to that the larger the diameter of the wire, the larger the heat dissipation amount from the connecting terminal to the wire, and the smaller the temperature rise of the connecting terminal.

Thus, the use of the Equation (7) allows predicting, in a design phase, the temperature increase of the connecting terminal when a current flows. Further, the use of the Equation (7) makes it possible to avoid conducting the temperature rise test to verify whether or not the temperature increase conforms to the temperature standard of the connecting terminal each time a connecting terminal is newly designed and produced, thereby allowing the connecting terminal to be designed and developed in a speedy manner.

In the present invention, based on the findings described above, the contact resistance value $R_{ter}$ (Ω/mm) is determined such that the temperature increase is smaller than the permissive increase in temperature ΔT (° C.) representing the temperature increase of the connecting terminal up to the temperature standard. Accordingly, Equation (8) is established.

$$\Delta T > \Delta T1 = \alpha \times I^2 \times R_{ter} + \beta \times I^2 \times R_{wire} \quad \text{Equation (8)}$$

If Equation (8) is modified to express the normalized contact resistant value $R_{ter}$ (Ω/mm) of the connecting terminal, Equation (9) is established.

$$R_{ter} < \Delta T/(\alpha \times I^2) \times (\beta/\alpha) \times R_{wire} \quad \text{Equation (9)}$$

Then, values α and β are determined by experimental values, and Equation (10) is obtained.

$$R_{ter} < \Delta T/(752 \times I^2) - 3.7 \times R_{wire} \quad \text{Equation (10)}$$

In view of above, the relationship equation is obtained. Then, the connecting terminal is designed to have the normalized contact resistance value $R_{ter}$ which satisfies Equation (9), and therefore the temperature rise is smaller than the permissive increase in temperature ΔT (° C.) representing the temperature increase of the connecting terminal up to the temperature standard, thereby limiting the temperature rise of the connecting terminal when a current flows.

EXAMPLE

A detailed description of Examples of the present invention will now be provided. In the description, the above relationship equation is calculated by using some connecting terminals of actual use, and a comparison is made between a predictive value and a measured value based on the calculated relationship equation.

(Connecting Terminals Used)

Connecting terminal A: Box-type terminal (13 mm×6 mm, 66 mm long)

Connecting terminal B: Ring-spring-type terminal (ϕ7 mm, 51 mm long)

Connecting terminal C: Louvered terminal (ϕ9 mm, 70 mm long)

Connecting terminal D: Box-type terminal (3 mm×2.5 mm, 22 mm long)

Connecting terminal E: Box-type terminal (3 mm×2.5 mm, 22 mm long with a thickness increased by 20% with respect to Connecting terminal D)

Connecting terminal F: Box-type terminal (3 mm×2.5 mm, 22 mm long which is made of a copper alloy material whose electrical conductivity is 1.6 times higher with respect to Connecting terminal D)

Connecting terminal G: Louvered terminal (ϕ4 mm, 27 mm long)

(Method for Measuring Contact Resistance)

Voltage drop measurement is performed at the contact portion (i.e., crimp portion) of each connecting terminal with the wire.

(Method for Measuring Temperature)

A thermocouple is attached to immediately below the crimp portion of each female terminal, and the temperature of the portion is monitored.

<1> Calculation of Relationship Equation (Example 1)

Three kinds of connecting terminals A to C having different shapes are each subjected to measurement of contact resistance values (Ω) in the wire crimp portions of the male and female terminals to each of which an end of a wire 15 $mm^2$ in diameter is crimped and the joint portion where the male and female terminals are joined to each other, thereby obtaining the contact resistance value (Ω) of the whole connecting terminal which is the sum of the thus-measured values. At this time, the connecting terminals A to C are each subjected to measurement of lengths (mm) of the wire crimp portions of the male and female terminals and the joint portion, thereby obtaining the length (mm) of the contact portion which is the sum of the thus-measured lengths. Then, the contact resistance value (Ω) of the whole connecting terminal is divided by the length (mm) of the contact portion, thereby obtaining the normalized contact resistance value $R_{ter}$ (Ω/mm) of each of the connecting terminal. Further, the connecting terminals A to C are each subjected to measurement in temperature increase (° C.) with a current of 100 A flowing in the connected wires. The result is shown in Table 1 and FIG. 1.

TABLE 1

| | | Connecting terminal A | Connecting terminal B | Connecting terminal C |
|---|---|---|---|---|
| Contact resistance ($\times 10^{-6}\Omega$) | Crimp portion of female terminal | 0.508 | 0.335 | 0.383 |
| | Crimp portion of male terminal | 0.508 | 0.335 | 0.383 |
| | Joint portion | 76.000 | 60.000 | 124.000 |
| | Whole terminal | 76.016 | 60.670 | 124.766 |
| Length (mm) | Crimp portion of female terminal | 10.0 | 18.0 | 8.0 |
| | Crimp portion of male terminal | 10.0 | 13.0 | 8.0 |
| | Joint portion | 48.0 | 20.0 | 53.5 |
| | Whole terminal | 68.0 | 51.0 | 69.5 |
| $R_{ter}$($\times 10^{-6}\Omega$/mm) | | 1.133 | 1.190 | 1.795 |
| Temperature increase (° C.) | | 39.7 | 40.2 | 44.9 |

According to FIG. 1, it is found that the temperature increase (° C.) of each connecting terminal when a current of 100 A flows is expressed using the normalized contact resistance value $R_{ter}$ (Ω/mm) of first order, even in connecting terminals having different shapes such as connecting terminals A to C.

Figure 2:
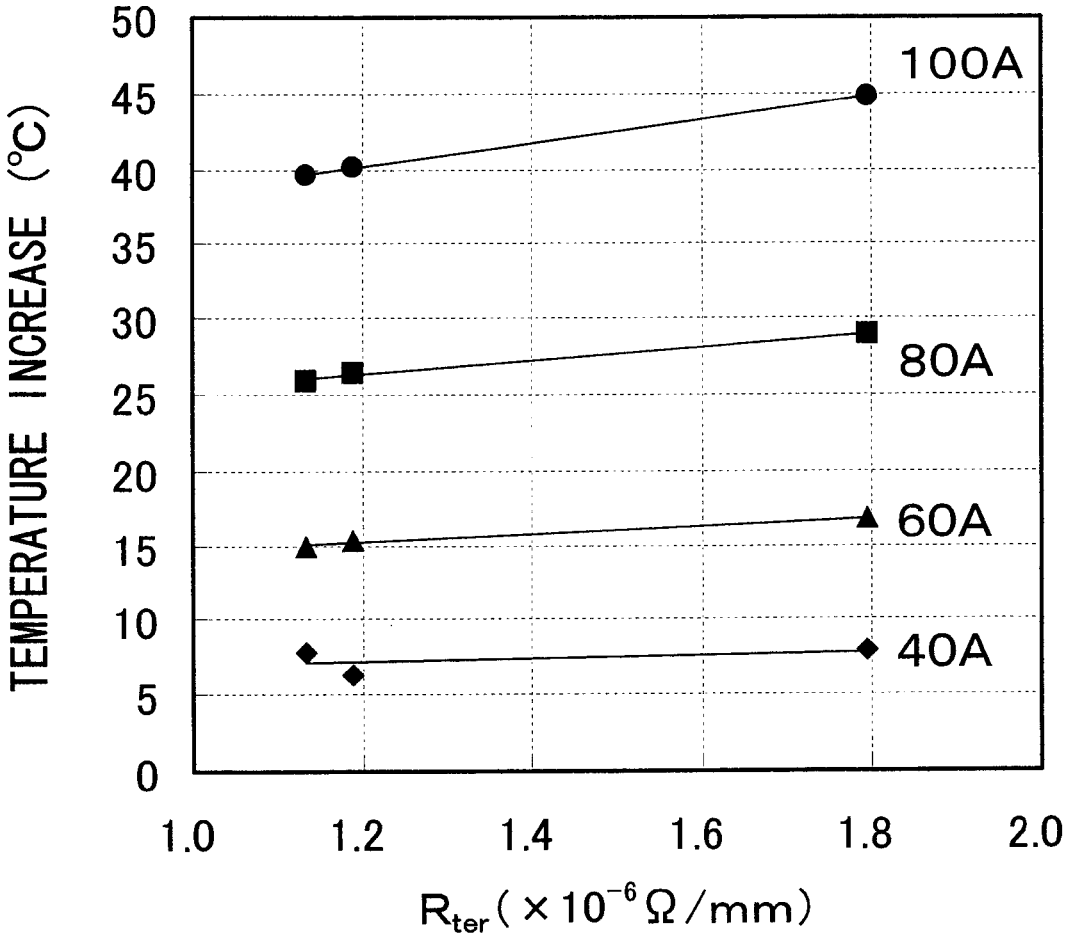
FIG. 2 is a graph showing a relationship between the temperature increase (° C.) and the normalized contact resistance value $R_{ter}$ (Ω/mm) of the connecting terminal at each current value, where the wire size is 15 $mm^2$.

Now, the connecting terminals A to C are each subjected to measurement of temperature increase (° C.) at each current condition indicated in Table 2 in relation to the normalized contact resistance value $R_{ter}$ (Ω/mm) The result is shown in Table 2 and FIG. 2.

TABLE 2

| | $R_{ter}$ | Temperature increase (° C.) | | | |
|---|---|---|---|---|---|
| | $\times 10^{-6}$ Ω/MM | 100 A | 80 A | 60 A | 40 A |
| Connecting terminal A | 1.133 | 39.7 | 25.9 | 15.0 | 7.8 |
| Connecting terminal B | 1.190 | 40.2 | 26.5 | 15.3 | 6.4 |
| Connecting terminal C | 1.795 | 44.9 | 29.0 | 16.8 | 7.9 |

As shown in FIG. 2, the temperature increase (° C.) of each connecting terminal at each current condition is still expressed using the normalized contact resistance value $R_{ter}$ (Ω/mm) of first order.

Here, according to Equation (7), a gradient of each graph showing a relationship between the normalized contact resistance value $R_{ter}$ (Ω/mm) and the temperature increase (° C.) of the connecting terminal is to become $\alpha \times I^2$, and the constant α of Equation (7) is obtained by obtaining the gradient of each graph according to FIG. 2 and using a relationship between $I^2$ and $\alpha \times I^2$. The result is shown in Table 3 and FIG. 3.

TABLE 3

| Current A | Gradient $\times 10^6$ | $I^2$ $\times 10^3 A^2$ | $\alpha \times I^2$ $\times 10^6 K$ |
|---|---|---|---|
| 100 | 7.8 | 10.0 | 7.8 |
| 80 | 4.5 | 6.4 | 4.5 |
| 60 | 2.6 | 3.6 | 2.6 |
| 40 | 1.1 | 1.6 | 1.1 |

Figure 3:
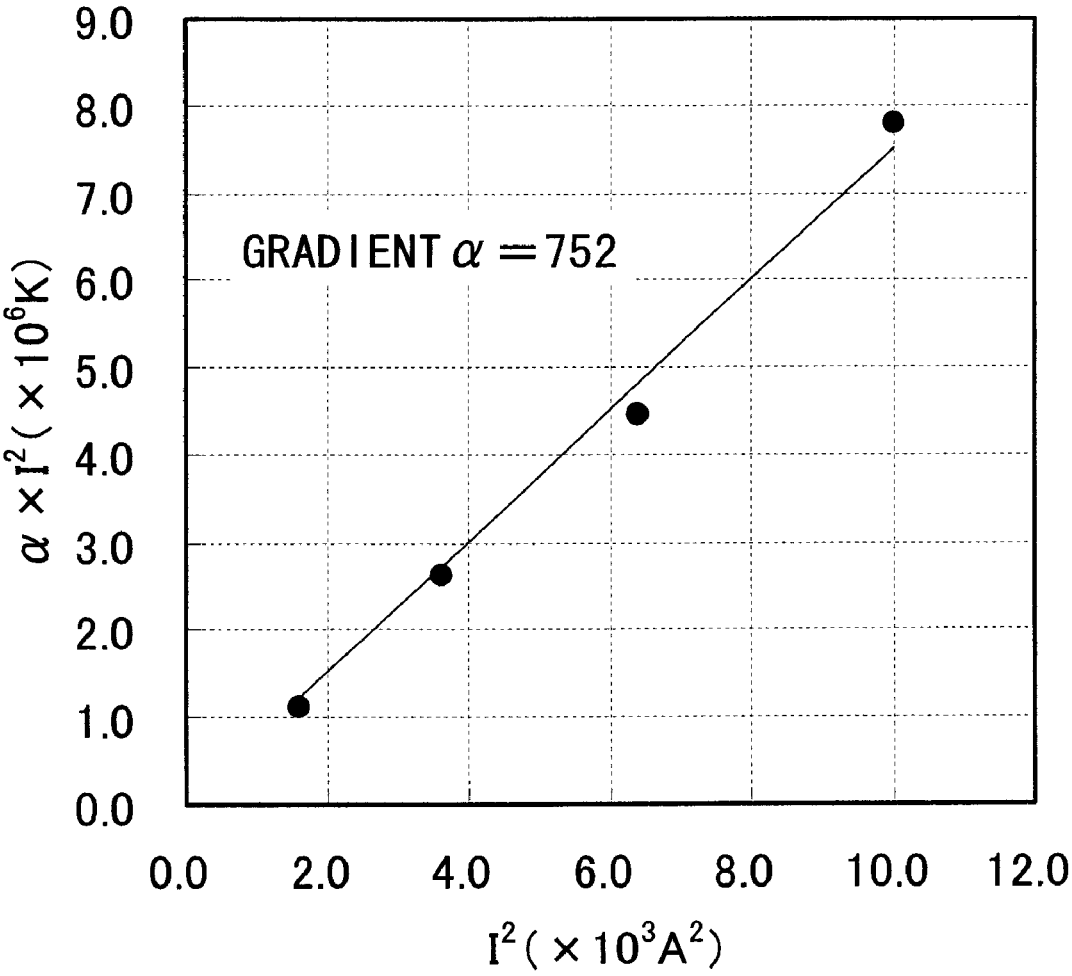
FIG. 3 is a graph showing a relationship between $I^2$ and $\alpha\times I^2$ for obtaining a constant $\alpha$ at a current value of 100 A, where the wire size is 15 $mm^2$.

According to the graph shown in FIG. 3, the gradient α=752 is obtained.

Subsequently, the value β in Equation (7) is obtained. The β is a value belonging to the second term ($\beta \times I^2 \times R_{wire}$) in Equation (7). The value of the second term ($\beta \times I^2 \times R_{wire}$) in Equation (7) is obtained according to the values of ΔT1 (° C.) and the first term ($\alpha \times I^2 \times R_{ter}$) in Equation (7) at each current condition. Then, the constant β is obtained in view of the relationship between $I^2 \times R_{wire}$ and $\beta \times I^2 \times R_{wire}$. The result is shown in Table 4 and FIG. 4.

TABLE 4

| Current A | Temperature increase ° C. | $\alpha \times I^2 \times R_{ter}$ ° C. | $\beta \times I^2 \times R_{wire}$ ° C. | $I^2 \times R_{wire}$ $\times 10^{-2}$W |
|---|---|---|---|---|
| 100 | 39.7 | 8.9 | 30.8 | 1.118 |
| 80 | 25.9 | 5.0 | 20.9 | 0.716 |
| 60 | 15 | 3.0 | 12.0 | 0.402 |
| 40 | 7.8 | 1.3 | 6.5 | 0.179 |

Where $R_{wire}$ of 15 $mm^2$ wire = $1.118 \times 10^{-6}\Omega$/mm

Figure 4:
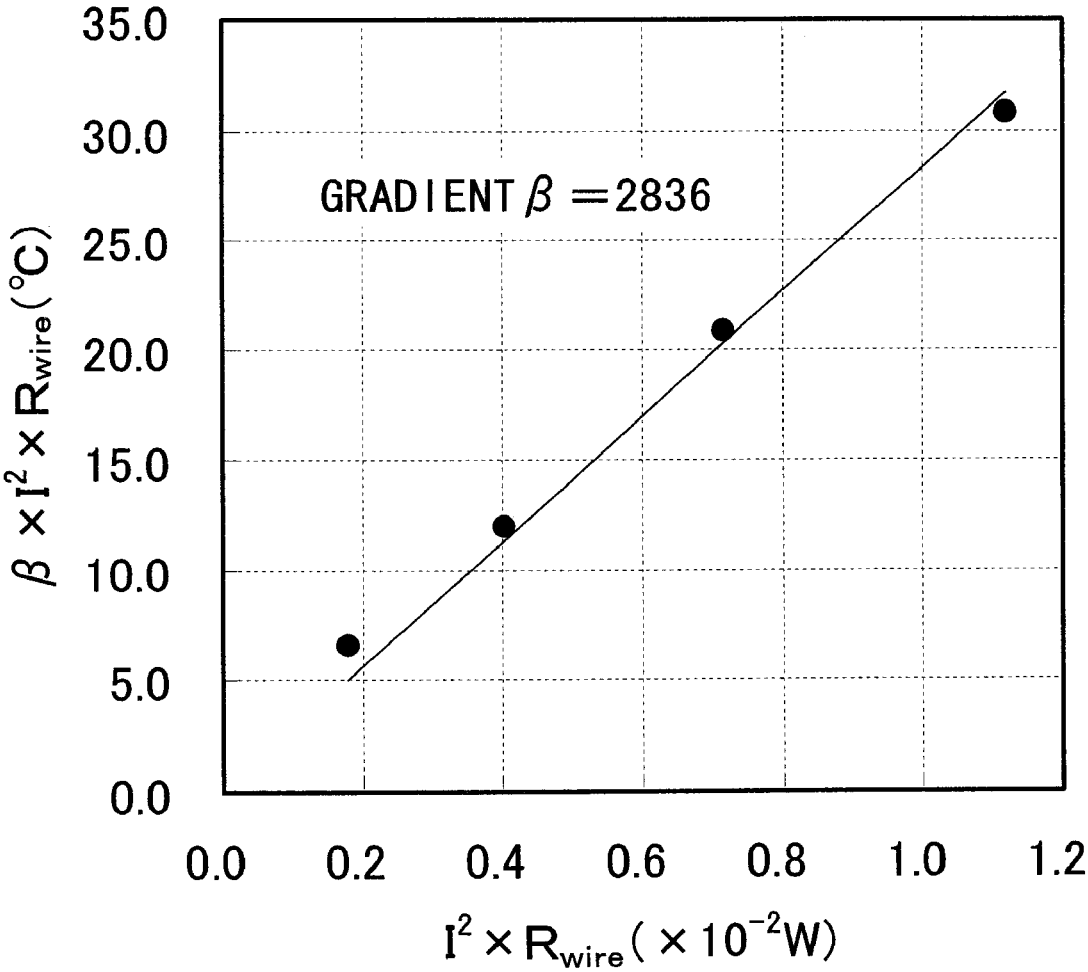
FIG. 4 is a graph showing a relationship between $I^2\times R_{wire}$ and $\beta\times I^2\times R_{wire}$ for obtaining a constant $\beta$ at a current value of 100 A, where the wire size is 15 $mm^2$.

According to the graph shown in FIG. 4, the gradient β=2836 is obtained. In view of the above, a relationship equation between the normalized contact resistance value $R_{ter}$ (Ω/mm) and the temperature increase ΔT1 (° C.) of the connecting terminal is determined as Equation (11).

$$\Delta T1 = 752 \times I^2 \times R_{ter} + 2836 \times I^2 \times R_{wire} \quad \text{Equation (11)}$$

Example 2

The normalized contact resistance value $R_{ter}$ (Ω/mm) of each of four types of connecting terminals having different shapes is calculated in a similar manner to Example 1 except that a wire 3 $mm^2$ in diameter is used. Further, the connecting terminals D to G are each subjected to measurement of temperature increase (° C.) with a current of 34 A flowing in the connected wires. The result is shown in Table 5 and FIG. 5.

TABLE 5

| | $R_{ter}$ $\times 10^{-6}\Omega$/mm | Temperature increase ° C. |
|---|---|---|
| Connecting terminal D | 40.0 | 55.5 |
| Connecting terminal E | 27.3 | 46.0 |
| Connecting terminal F | 26.5 | 46.0 |
| Connecting terminal G | 11.1 | 29.4 |

Figure 5:
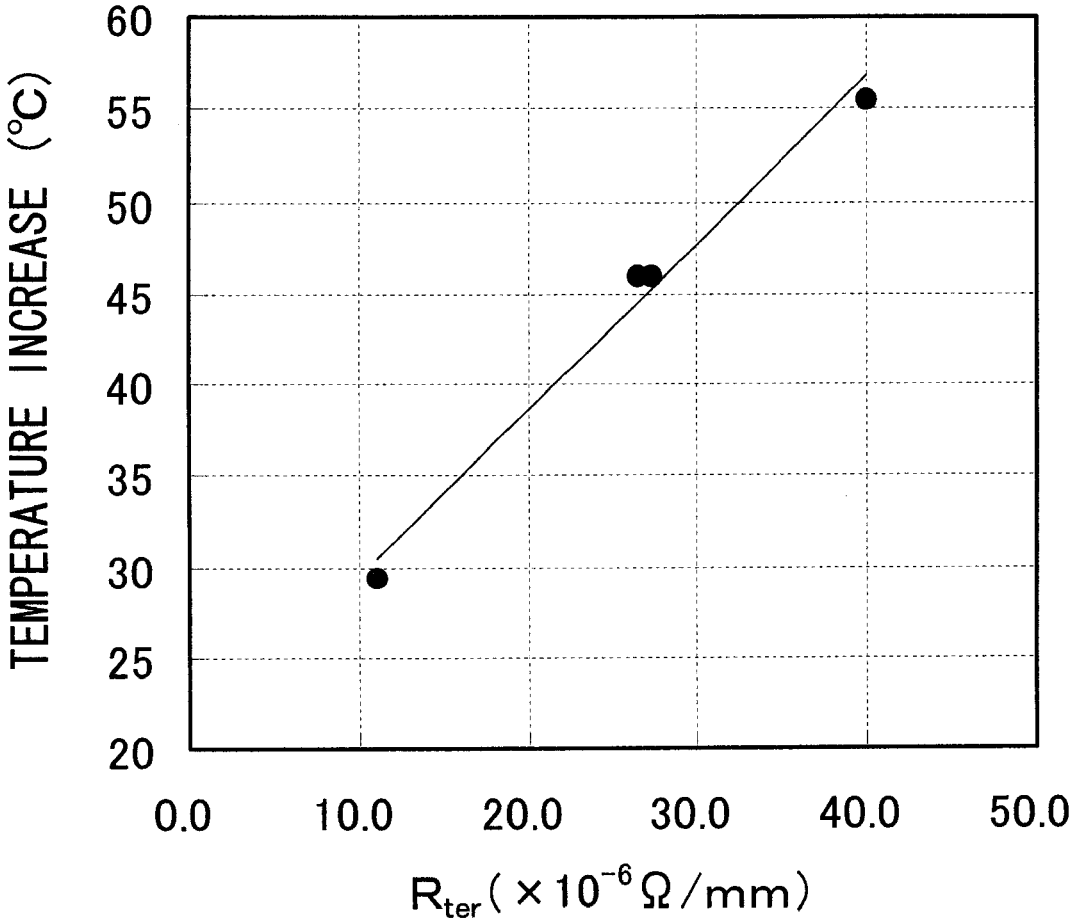
FIG. 5 is a graph showing a relationship between the temperature increase (° C.) and the normalized contact resistance value $R_{ter}$ (Ω/mm) of the connecting terminal at a current value of 34 A, where the wire size is 3 $mm^2$.

According to Table 5 and FIG. 5, it is found, similarly to Example 1, that the temperature increase (° C.) of each connecting terminal is expressed using the normalized contact resistance value $R_{ter}$ (Ω/mm) of first order, even in connecting terminals having different shapes. At this time, the gradient of the graph shown in FIG. 5 is $0.9 \times 10^6$.

According to Equation (7), the gradient of the graph is to become $\alpha \times I^2$. The gradient of the graph ($\alpha \times I^2$) obtained according to FIG. 5 is plotted on the graph showing the relationship between $I^2$ and $\alpha \times I^2$ which is used when obtaining the constant α in Example 1. The result is shown in Table 6 and FIG. 6.

TABLE 6

| Current A | Gradient $\times 10^6$ | $I^2$ $\times 10^3 A^2$ | $\alpha \times I^2$ $\times 10^6 K$ |
|---|---|---|---|
| 100 | 7.8 | 10.0 | 7.8 |
| 80 | 4.5 | 6.4 | 4.5 |
| 60 | 2.6 | 3.6 | 2.6 |
| 40 | 1.1 | 1.6 | 1.1 |
| 34 | 0.9 | 1.2 | 0.9 |

Figure 6:
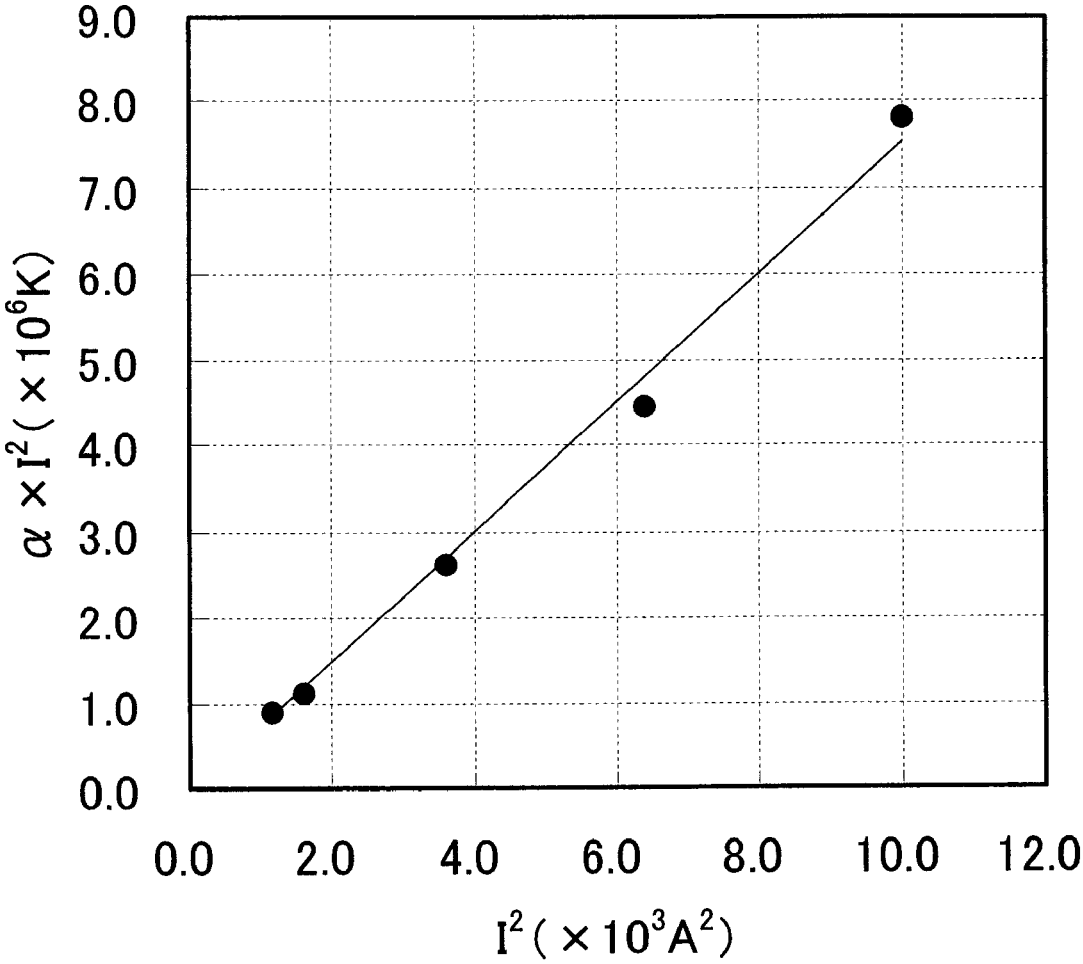
FIG. 6 is a graph showing a relationship between $I^2$ and $\alpha \times I^2$ at current values of 34 A and 100 A where the wire sizes are 3 $mm^2$ and 15 $mm^2$, respectively.

According to FIG. 6, it is found that the gradient of the graph obtained according to FIG. 5 lays almost on the straight line of the graph representing the relationship between $I^2$ and $\alpha \times I^2$ which is used when obtaining the constant $\alpha$ in Example 1.

Subsequently, as to the connecting terminal D, a value of the second term ($\beta \times I^2 \times R_{wire}$) in Equation (7) is calculated from the gradient of the graph ($\alpha \times I^2$) obtained according to FIG. 5, the normalized contact resistance value $R_{ter}$ (Ω/mm) and the temperature increase (° C.) in the connecting terminal D, and is plotted on the graph showing the relationship between $I^2 \times R_{wire}$ and $\beta \times I^2 \times R_{wire}$ which is used when obtaining the constant $\beta$ in Example 1. The result is shown in Table 7 and FIG. 7.

TABLE 7

Figure 7:
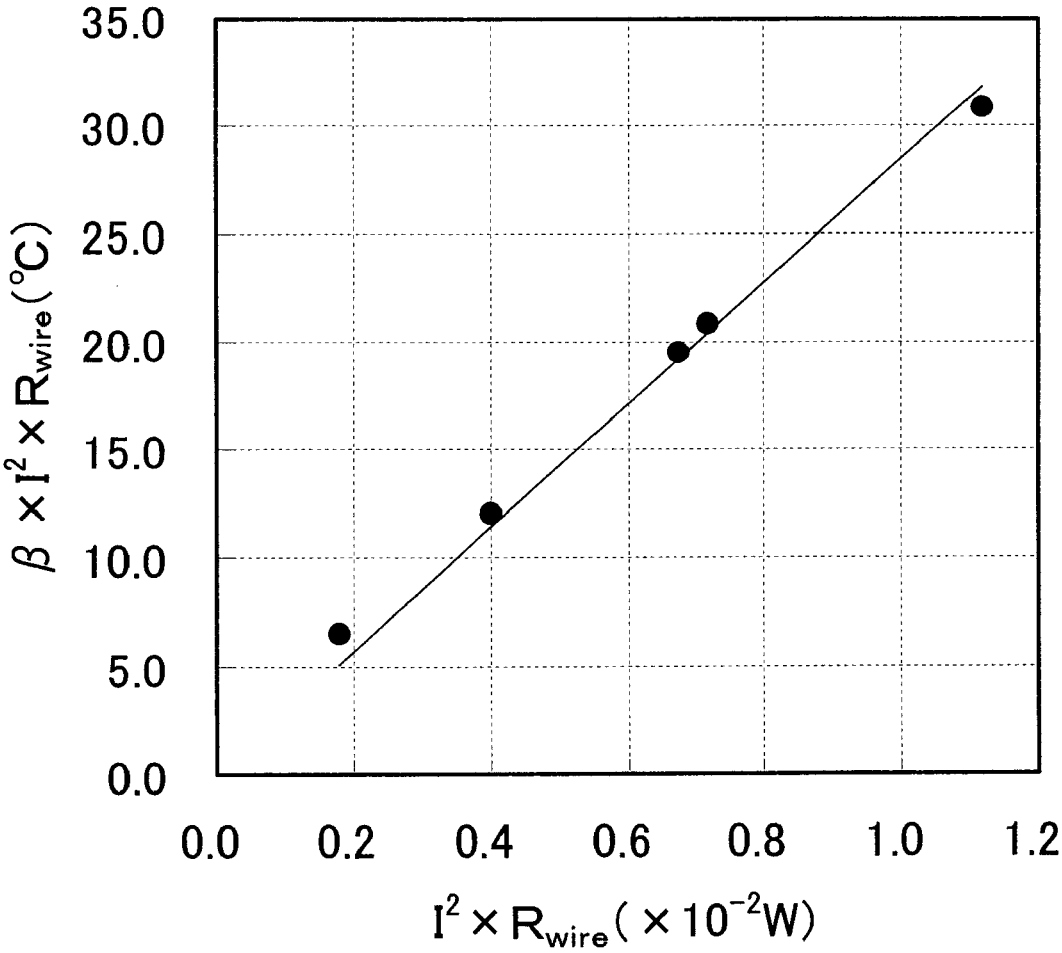
FIG. 7 is a graph showing a relationship between $I^2 \times R_{wire}$ and $\beta \times I^2 \times R_{wire}$ at current values of 34 A and 100 A where the wire sizes are 3 $mm^2$ and 15 $mm^2$, respectively.

| Current A | Temperature increase ° C. | $\alpha \times I^2 \times R_{ter}$ ° C. | $\beta \times I^2 \times R_{wire}$ ° C. | $I^2 \times R_{wire}$ $\times 10^{-2}$W |
|---|---|---|---|---|
| 100 | 39.7 | 8.9 | 30.8 | 1.118 |
| 80 | 25.9 | 5.0 | 20.9 | 0.716 |
| 60 | 15 | 3.0 | 12.0 | 0.402 |
| 40 | 7.8 | 1.3 | 6.5 | 0.179 |
| 34 | 55.5 | 36.0 | 19.5 | 0.674 |

Where $R_{wire}$ of 15 $mm^2$ wire = $1.118 \times 10^{-6}$Ω/mm
$R_{wire}$ of 3 $mm^2$ wire = $5.833 \times 10^{-6}$Ω/mm According to FIG. 7, it is found that the value of the second term ($\beta \times I^2 \times R_{wire}$) in Equation (7) as to the connecting terminal D is plotted almost on the straight line of the graph representing the relationship between $I^2 \times R_{wire}$ and $\beta \times I^2 \times R_{wire}$ which is used when obtaining the constant $\beta$ in Example 1.

As described above, it is verified that even in connecting terminals having different shapes, the temperature increase (° C.) of the connecting terminal is expressed using the normalized contact resistance value $R_{ter}$ (Ω/mm) of first order, and the values of the constants $\alpha$ and $\beta$ become equal. That is to say, Equation (11) can be also used for predicting the temperature increases ΔT1 (° C.) of the connecting terminals having different shapes.

Comparative Example 1

Similarly to Example 1, the three kinds of connecting terminals A to C having different shapes are each subjected to measurement of contact resistance value (Ω) between leading ends of the female and male terminals joined to each other with a wire 15 $mm^2$ in diameter being crimped to each of them. In addition, the temperature increase (° C.) of each connecting terminal is measured with a current of 100 A flowing in the connected wire. The result is shown in Table 8 and FIG. 8.

TABLE 8;

| | Contact resistance $\times 10^{-3}$Ω | Temperature increase ° C. |
|---|---|---|
| Connecting terminal A | 0.078 | 39.7 |
| Connecting terminal B | 0.048 | 40.2 |
| Connecting terminal C | 0.129 | 44.9 |

Figure 8:
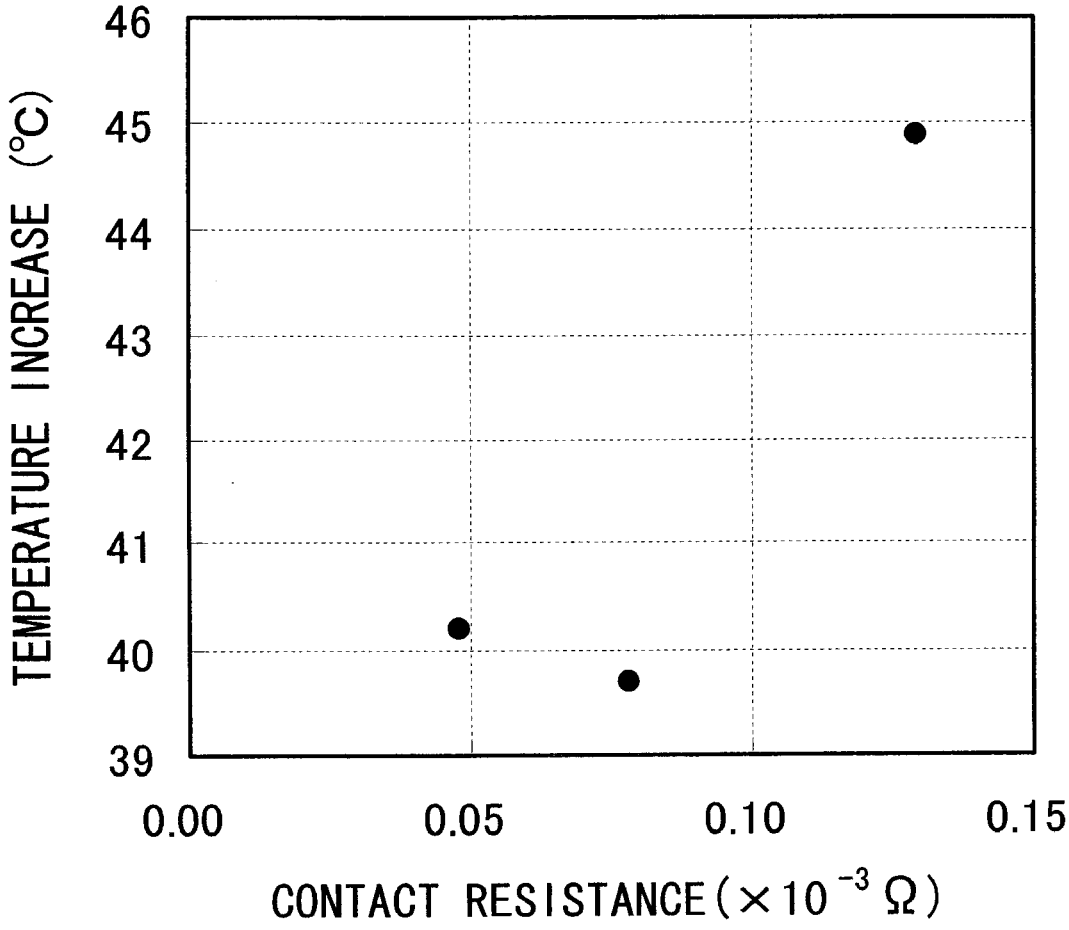
FIG. 8 is a graph (comparative example) showing a relationship between the temperature increase (° C.) and a contact resistance value R (Ω/mm) of the connecting terminal at a current value of 100 A, where the wire size is 15 $mm^2$.

As is indicated in FIG. 8, no significant correlation is found between the contact resistance values and the temperature increases between the leading ends of the female and male terminals. Due to the reason, no prediction can be made as to the temperature increase of the connecting terminal from the contact resistance value.

<2> Comparison Between Predictive Value and Measured Value Based on the Foregoing Relationship Equation Example 3

The connecting terminal F used in Example 2 and a newly-developed connecting terminal H different in shape from the connecting terminal F are subjected to a resistance test (high temperature exposure: 120° C., 120 H) to conduct a temperature rise test for measuring the initial temperature increase and the post-test temperature increase. A wire 3 $mm^2$ in diameter is used and a current value of 34 A is applied. The result is shown in Table 9.

TABLE 9

| | Contact resistance $R_{ter}$ $\times 10^{-6}$Ω/mm | Temperature increase (° C.) Predictive value | Measured value |
|---|---|---|---|
| Connecting terminal F (Initial) | 26.5 | 42.2 | 46.0 |
| Connecting terminal F (Post test) | 34.5 | 49.2 | 51.2 |
| Connecting terminal H (Initial) | 30.1 | 45.3 | 44.2 |
| Connecting terminal H (Post test) | 57.2 | 61.2 | 59.8 |

Table 9 shows that the predictive values of temperature increase of the connecting terminals F and H are close to the respective measured values in both the measurements before and after the resistance test. Further, a measurement of a post-test contact resistance allows easily predicting not only the initial temperature increase but also the post-test temperature increase. That is to say, the present invention allows the development term of a terminal to be reduced.

As described above, Equation (11) enables to predict, in the design phase, the temperature increase of a connecting terminal when a current flows, which makes it possible to avoid conducting the temperature rise test for verifying whether or not the temperature increase conforms to the temperature standard of the connecting terminal each time a connecting terminal is newly designed and preproduced, thereby allowing the connecting terminal to be designed and developed in a speedy manner. In addition, the contact resistance value $R_{ter}$ is determined such that the temperature increase is smaller than the permissive increase in temperature representing the temperature increase of the connecting terminal up to the temperature standard, thereby limiting the temperature rise of the connecting terminal when a current flows.

Figure 9:
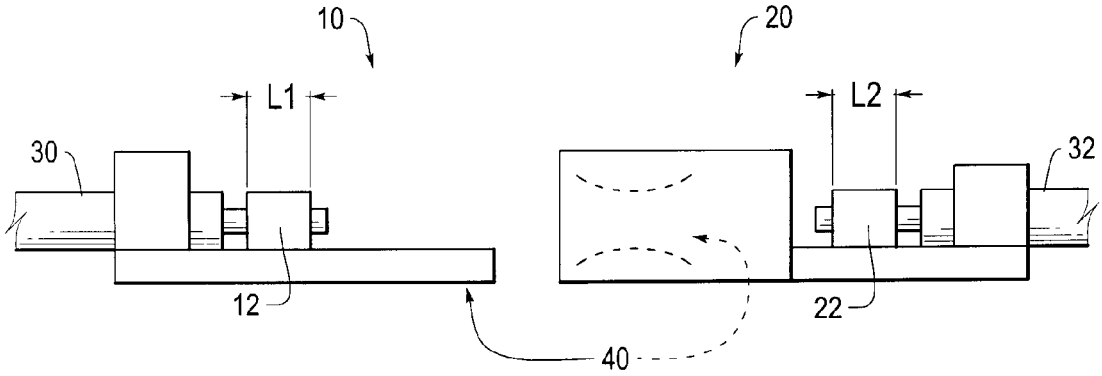
FIGS. 9 and 10 illustrate the male terminal and the female terminal separated and joined to each other, respectively.
Figure 10:
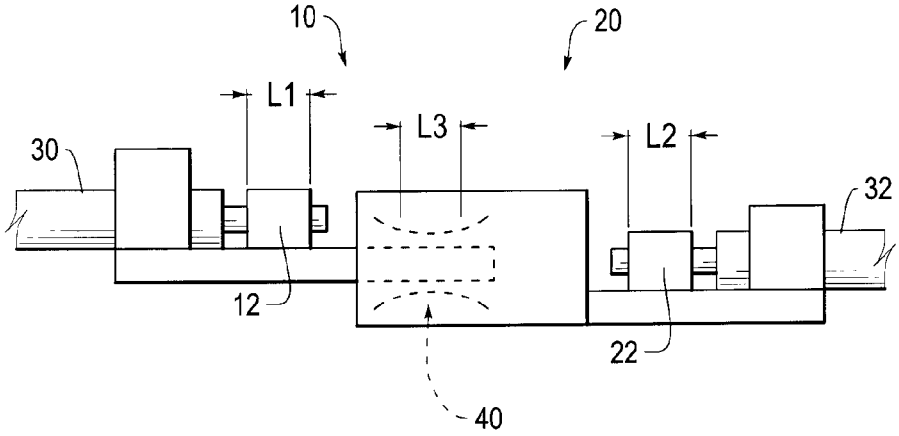

FIGS. 9 and 10 illustrate a male terminal 10 having a wire crimp portion 12 to which an end of a wire 30 is crimped, a female terminal 20 having a wire crimp portion 22 to which an end of a wire 32 is crimped, and a joint portion 40 where the male terminal 10 and the female terminal 20 are joined to each other. As illustrated, a length of a contact portion is a sum of a length L1 of the wire crimp portion 12 of the male terminal 10, a length L2 of the wire crimp portion 22 of the female terminal 20 and a length L3 of the joint portion 40.

The foregoing description of preferred embodiments is presented for purposes of illustration. However, it is not intended to limit the present invention to the preferred embodiment, and modifications and variations are possible as long as they do not deviate from the principles of the present invention.

For example, the preferred embodiment of the present invention illustrates two kinds of wires 15 $mm^2$ and 3 $mm^2$ in diameter; however, any wire is applicable which has a diameter falling within the range between the diameters of the above-mentioned two wires. In addition, the shape of the connecting terminal is of course not limited to the shapes of the connecting terminals A to H.

The invention claimed is:

1. A connecting terminal, comprising:

a male terminal having a wire crimp portion to which an end of a wire is crimped;

a female terminal having a wire crimp portion to which an end of a wire is crimped; and a joint portion where the male and female terminals are joined to each other, wherein a contact resistance value of the whole connecting terminal is a sum of a contact resistance value in the wire crimp portion of the male terminal, a contact resistance value in the wire crimp portion of the female terminal and a contact resistance value in the joint portion, and a length of a contact portion is a sum of a length of the wire crimp portion of the male terminal, a length of the wire crimp portion of the female terminal and a length of the joint portion, wherein a normalized contact resistance value $R_{ter}$ is derived by dividing the contact resistance value of the whole connecting terminal by the length of the contact portion; and wherein a relationship of a wire resistance value $R_{wire}$ of the wire, a current value I and a permissive increase in temperature $\Delta T$ to the normalized contact resistance value $R_{ter}$ of the connecting terminal is expressed by $R_{ter} < \Delta T/(752 \times I^2) - 3.7 \times R_{wire}$, the permissive increase in temperature $\Delta T$ representing a temperature increase up to a temperature standard of the connecting terminal.

* * * * *